US010252897B2

(12) United States Patent
Thompson

(10) Patent No.: US 10,252,897 B2
(45) Date of Patent: Apr. 9, 2019

(54) SELF-SEALING BOTTLE HOLDER

(71) Applicant: Travis Thompson, Indianapolis, IN (US)

(72) Inventor: Travis Thompson, Indianapolis, IN (US)

( * ) Notice: Subject to any disclaimer, the term of this patent is extended or adjusted under 35 U.S.C. 154(b) by 40 days.

(21) Appl. No.: 15/599,411

(22) Filed: May 18, 2017

(65) Prior Publication Data

US 2018/0334369 A1 Nov. 22, 2018

(51) Int. Cl.
*B67B 3/28* (2006.01)

(52) U.S. Cl.
CPC ..... *B67B 3/28* (2013.01)

(58) Field of Classification Search
CPC ... A47G 23/025; A47G 23/0241; A47B 73/00
USPC ..... 211/76; 220/740; 248/312.1
See application file for complete search history.

(56) References Cited

U.S. PATENT DOCUMENTS 334,983 A * 1/1886 Reynolds et al. ... A47G 23/025 211/76
425,523 A * 4/1890 Rosen ..... A47B 73/00 211/74
426,811 A 4/1890 Henkel
615,460 A * 12/1898 Parker ..... A47G 23/0241 215/395
709,819 A 9/1902 Hicks
822,984 A * 6/1906 Richter ..... A47B 73/00 206/446
1,141,687 A * 6/1915 Brunhoff ..... A47G 23/025 211/76
1,203,202 A * 10/1916 Kinsella ..... A47G 23/025 211/76
1,293,788 A * 2/1919 Jacklich ..... A47G 23/025 116/2
2,205,922 A * 6/1940 Cravaritis ..... A47G 23/025 211/4
2,292,651 A * 8/1942 Olevin ..... A47G 19/24 211/76
2,710,694 A 6/1955 Carr
3,483,997 A * 12/1969 Ritter ..... B01L 9/06 211/76
4,040,234 A * 8/1977 Stockdale ..... B01L 9/06 53/471
4,050,584 A 9/1977 Lino
(Continued)

FOREIGN PATENT DOCUMENTS

EP 0631816 A1 1/1995

*Primary Examiner* — Bradley Duckworth
(74) *Attorney, Agent, or Firm* — Frost Brown Todd, LLC

(57) ABSTRACT

A bottle holder that automatically seals a bottle opening when the bottle holder is placed for storage. The bottle may rest within a recess of the holder base, and the nozzle of the bottle is held in place by a nozzle catch that is conically shaped and has an inner cup that tapers to a terminal point so that a nozzle that it placed within will be sealed by the inner wall of the cup. The nozzle catch is spring loaded and presses down against the bottle to hold it in place and maintain a seal on the nozzle. A bottle may be placed in the holder by positioning a nozzle in the nozzle catch on the upper side of the holder and pushing upwards and inwards, which causes the spring to compress and allows the bottle bottom to pass over the base and into the recess.

17 Claims, 11 Drawing Sheets

(56) References Cited

U.S. PATENT DOCUMENTS 5,238,160 A * 8/1993 Faulds ..... B62J 11/00
215/399
5,582,222 A * 12/1996 Riall ..... B01L 9/00
141/326

* cited by examiner

SELF-SEALING BOTTLE HOLDER

FIELD

The disclosed technology pertains to an apparatus for holding and sealing bottles containing various substances.

BACKGROUND

Many jobs, hobbies and tasks require the use of liquid materials. For example, a person preparing a meal, whether professionally or in the comfort of their home, may use various vinegars, oils, syrups, sauces, or other liquid or semi-liquid ingredients. Likewise, a craftsman working with wood or other materials may use various types of stains, sealers, glues, and solvents during their work. As yet another example, a mechanic servicing automobiles, motorcycles, or even bicycles, may use oils, lubricants, solvents, dyes, powders, and other liquid, semi-liquid, or even fine powdered materials during the servicing and diagnosis of mechanical problems.

Such materials may be purchased in a variety of containers. Often, the container that a material is sold in may not be convenient for tasks with which it is commonly used. For example, cooking oil may be bought in bulk jugs holding a gallon or more, which may have a size and weight that make them inconvenient for pouring into a skillet or teaspoon. Some cleaning supplies or solvents may be purchased in a spray bottle that is inconvenient for precise application or soaking. Glues may be purchased in bottles that have twistable or foldable nozzles, which may be inconvenient for frequent use that may require repetitive twisting or manipulation to open and close the bottle. Due to the variety of containers that materials are purchased in, some users will move the material to a container that is more convenient for their own purposes. Often, this may be a simple bottle with a conical nozzle that dispenses the material by operation of gravity or due to a shaking or squeezing force applied to the bottle. While such a bottle may allow for easier use, it also introduces a possibility of spillage, evaporation, drying, or spoilage unless it is kept capped by, for example, a removable cap. However, introducing a removable cap reduces the convenience of the bottle, as it must be removed and replaced after use, and may also be easily lost or damaged by a glue or solvent.

What is needed, therefore, is an improved system for storing and sealing bottles containing materials.

BRIEF DESCRIPTION OF THE DRAWINGS

The drawings and detailed description that follow are intended to be merely illustrative and are not intended to limit the scope of the invention as contemplated by the inventors.

DETAILED DESCRIPTION

The inventor has conceived of novel technology that, for the purpose of illustration, is disclosed herein as applied in the context of a self-sealing bottle storage apparatus. While the disclosed applications of the inventor's technology satisfy a long-felt but unmet need in the art of self-sealing bottle storage, it should be understood that the inventor's technology is not limited to being implemented in the precise manners set forth herein, but could be implemented in other manners without undue experimentation by those of ordinary skill in the art in light of this disclosure. Accordingly, the examples set forth herein should be understood as being illustrative only, and should not be treated as limiting.

Figure 1:
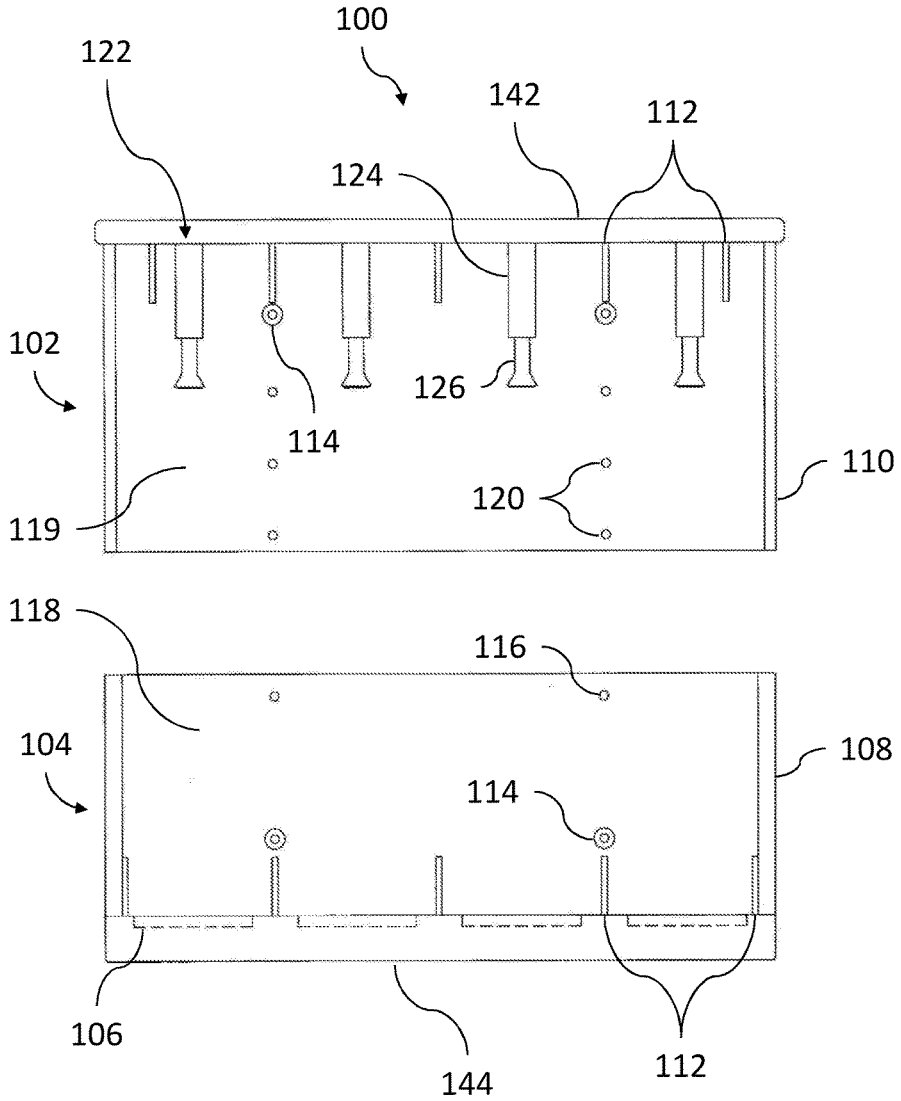
FIG. 1 is a front elevation view of an unassembled bottle holder.
Figure 9:
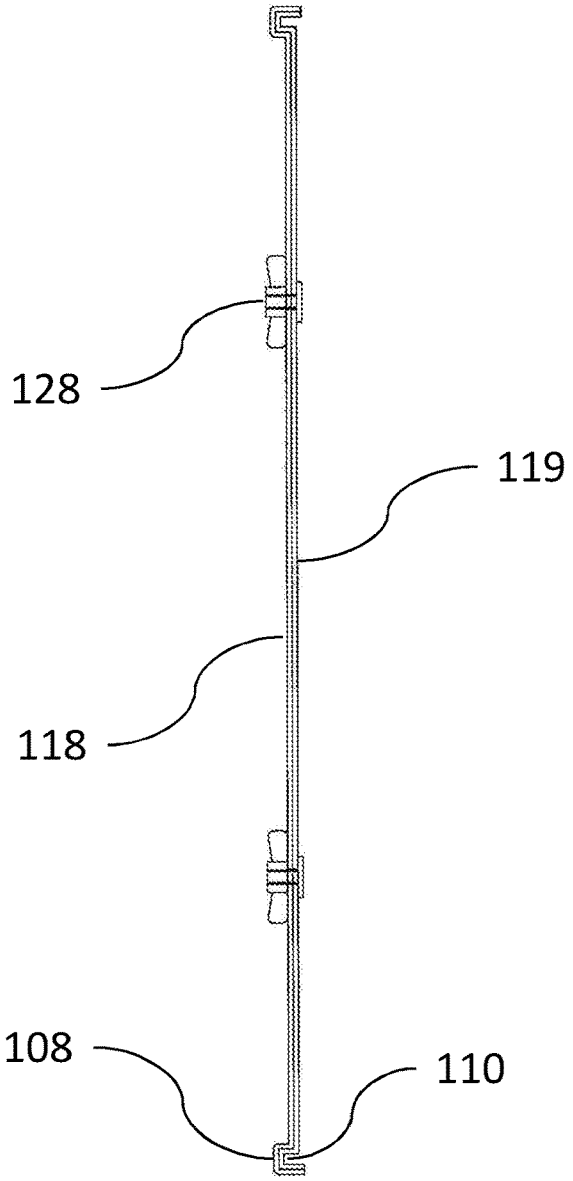
FIG. 9 is a top cross-sectional view of an overlapping assembly portion of the bottle holder.

Turning now to the figures, FIG. 1 shows a front elevation view of an unassembled bottle holder (100). The bottle holder (100) comprises an upper frame (102) and a lower frame (104). The upper frame (102) has a set of rear fastener holes (120) on both the right and left side, and an upper rail (110) on both the left and the right side. The lower frame (104) has a front fastener hole (116) on both the right and left side, as well as a lower rail (108) on the right and left side. When assembled, the lower portion of upper frame (102) may be placed behind the upper portion of lower frame (104) such that they overlap, and each upper rail (110) slides into the corresponding lower rails (108), while the front fastener holes (116) each line up with a rear fastener hole (120) of the upper frame (102). FIG. 9 shows an overhead cross-sectional view of a portion of the upper frame (102) and lower frame (104) where they overlap. As can be seen in FIG. 9, the upper rail (110) nests into a cavity of the lower rail (108). Once nested, one or more fasteners (128) may be passed through the front fastener holes (116) and rear fasteners holes (120) and tightened to pull an upper wall (119) of the upper frame (102) snugly against a lower wall (118) of the lower frame (104). Once fastened, the upper frame (102) and lower frame (104) will form the functional bottle holder (100).

Figure 2:
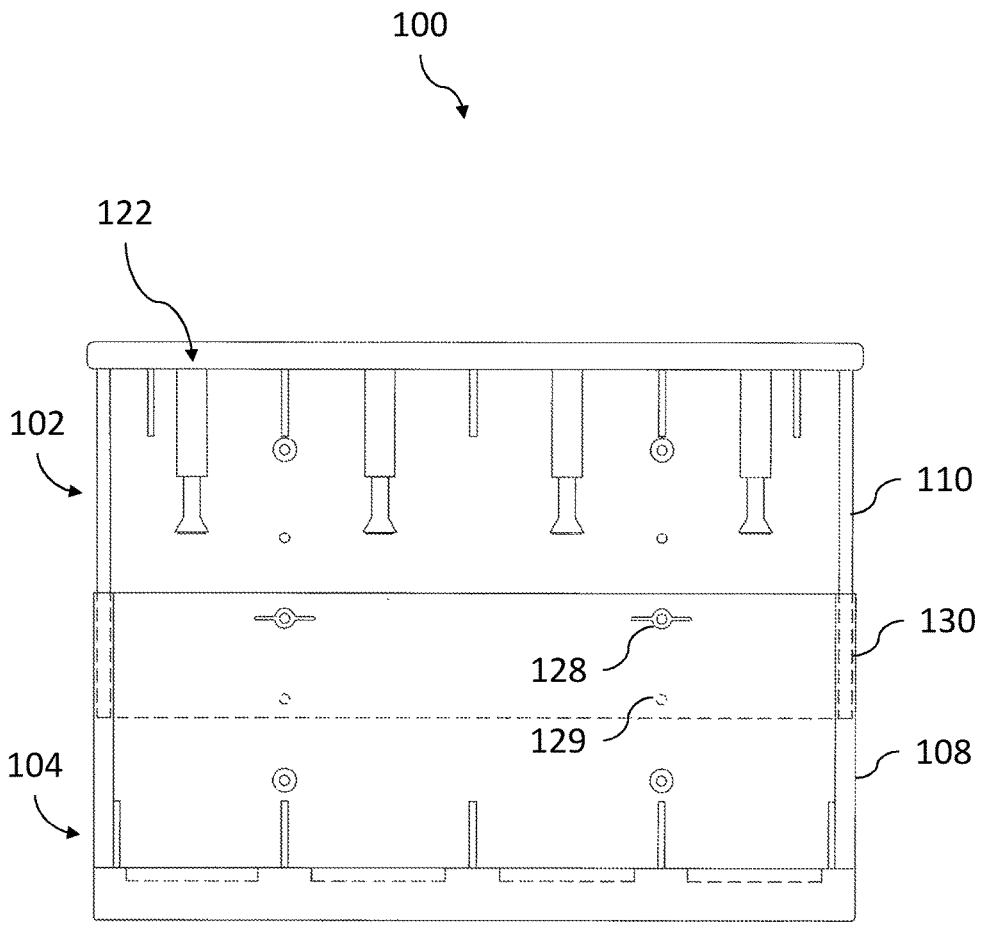
FIG. 2 is a front elevation view of a bottle holder.

Since the bottle holder (100) is comprised of the upper frame (102) and the lower frame (104), it may be disassembled for storage, packing, shipping, and other similar situations, and it may also allow for some adjustment of the overall height of the bottle holder (100). As seen in FIG. 1, the upper frame (102) has multiple ear fastener holes (120) disposed vertically along the height of the upper frame (102), and the upper rails (110) and lower rails (108) similarly run vertically along the height of each frame. Due to these features, the lower frame (104) can be placed in front of and fastened to the upper frame (102) with various amounts of overlap, such that a minimal overlap rear fastener hole (120) can be chosen to maximize the overall height of the bottle holder (100), and high overlap rear fastener hole (120) can be chosen to minimize the overall height of the bottle holder (100). For example, FIG. 2 shows a bottle holder (100) with the lower frame (104) placed in front of the upper frame (102), with the upper rail (110) being nested within the lower rail (108) across an overlap (130) region. A fastener (128) passes through a front fastener hole (116) and a rear fastener hole (120) and fixes the two frames (102, 104) together. Note the covered fastener hole (129) which is unused in FIG. 2, but which allows adjustment of bottle holder (100) to a different height were covered fastener hole (129) to be used by adjusting the overlap (130).

The bottle holder (100) also comprises a top (142) and a base (144). The depth of the base (144) may vary, and may typically be between about 3 and about 8 inches to accommodate bottles having various depths and to provide a stable base should a user desire to let the bottle holder rest on a flat surface rather than hanging it from a vertical surface via a set of mounting points (114) that allow for a screw, nail, or other such mounting hardware to be passed through the lower wall (118) or upper wall (119) and affix the bottle holder (100) to a structural wall or other vertical surface. The base (144) has one or more recesses (106) extending downwards into the base (144), which may be circular or square, and will have a circumference or perimeter that allows for the base of various sizes of bottles to be placed within and rest within the recess (106).

Figure 3:
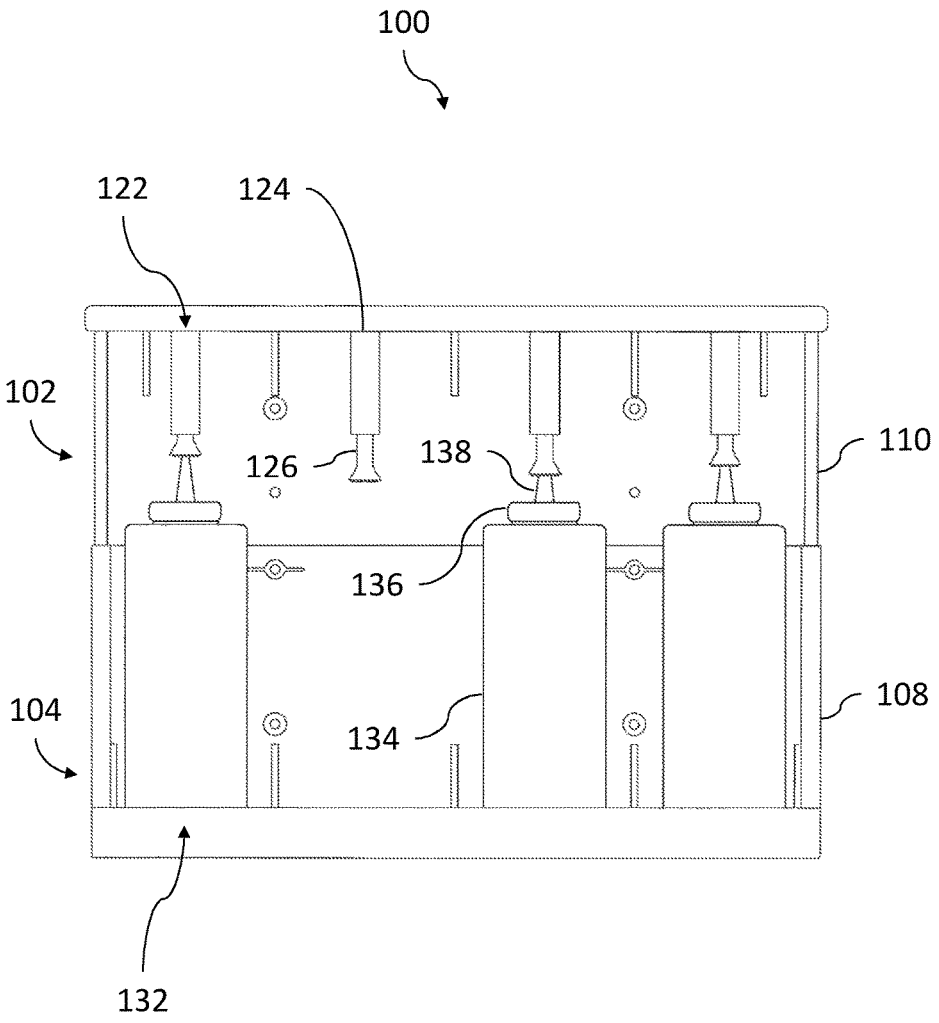
FIG. 3 is a front elevation view of the bottle holder containing several bottles.

The depth of the top (142) may vary, and may typically between about 3 and about 8 inches to accommodate bottles having various depths, and to provide enough depth that a nozzle catch (122) may extend downwards from the underside of the top (142) and be approximately centered over the recess (106), such that a bottle placed within the recess (106) will have a nozzle that is located centrally and extends upwards relative to the nozzle catch (122). For example, FIG. 3 shows the bottle holder (100) containing several bottles (132), each bottle comprising a body (134), a cap (136) affixed to the top of the body (134), and a nozzle (138) with an opening for releasing material stored within the bottle (132) extending from the cap (136). The bottles (132) are placed such that the lower portion of the bottle (132) is within the recess (106) (see FIG. 1) of the base (144), and the nozzle (138) rests within the nozzle cup (126) of the nozzle catch (122).

Figure 10:
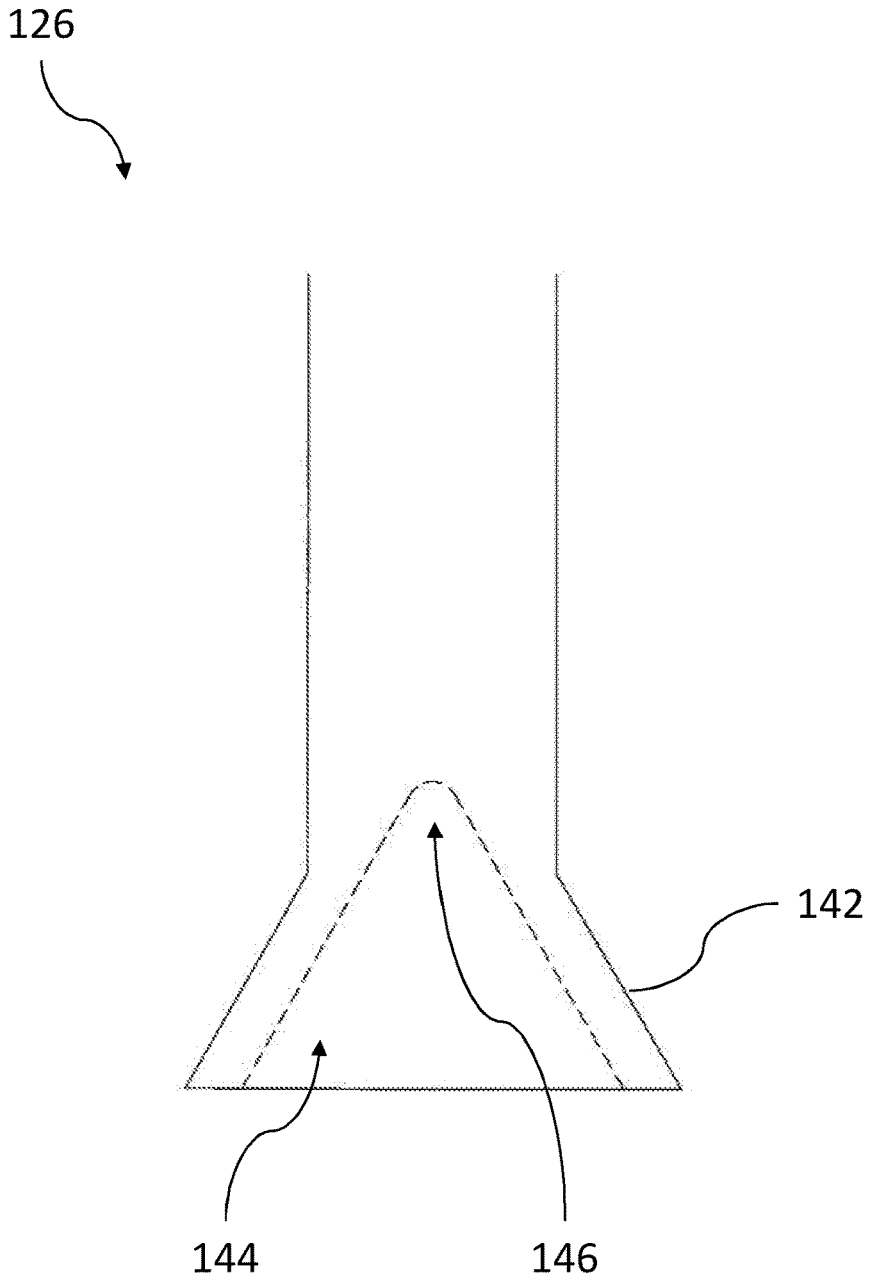
FIG. 10 is a side view of a nozzle cup of the bottle holder.

FIG. 10 shows an enlarged partial side view of the nozzle cup (126). A cup wall (142) is conical and extends outwards and downwards from the bottom of the nozzle cup (126). A cup (144) is hollowed out of the interior of the nozzle cup (126), and is surrounded by the cup wall (142). At the highest point of the cup (144), the cup walls (142) taper to a cup terminal (146) that closes off the cup (144). In this manner, bottles (132) having nozzles (138) of varying lengths, tapers, and opening circumferences can be inserted into the same cup (144). Depending upon the length and circumference of the nozzle, the nozzle (138) opening will either contact the cup wall (142) or the cup terminal (146) and be fully or partially sealed closed as a result. The depth of the cup terminal (146) and the tapering of the cup walls (142) can be varied to accommodate nozzles (138) of varying lengths and circumferences, and can be constructed of materials such as plastic or metal, which may provide durability, or rubbers or soft plastics, which may provide pliability and improved sealing. Since the nozzle catch (126) can accommodate (by holding in place and sealing) a large variety of nozzles (138), a user can select nozzles (138) with differing characteristics that are ideal for the particular material contained within or the application of such material. For example, a short nozzle having a large circumference opening, which may be appropriate for dispensing a high volume of viscous liquid such as glue, may contact the cup wall (142) and be sealed, while a long nozzle having a small circumference, which may be appropriate for dispensing a low volume of low viscosity liquid, may contact the cup terminal (146) and also be sealed. Other applications may be best served by nozzles with openings cut at an angle to yield an elliptical opening hole, for example, for shaping the liquid as it is applied.

The nozzle catch (122) comprises a post (124) that is hollow and that extends downwards from underside of the top (142), and a nozzle cup (126) that is mounted within the hollow portion of the post (124) and that is movable upwards and downwards within the post (124). A spring or some other fastening and biasing means may connect the post (124) to the nozzle cup (126) both for retention and so that the nozzle cup (126) may be pressed upwards into the post (124) and then return to a neutral position, as will be shown and described in more detail below. The top (142) and base (144) may be respectively connected to the upper wall (119) and lower wall (118) by a set of angle braces (112) disposed horizontally along the inside edge where the horizontal plane (142, 144) meets the vertical plane (118, 119). These angle braces (112) provide both strength and rigidity to the entire piece, and when placed as shown in FIG. 1 also serve as dividers for one or more bottles that may be placed in the areas between the one or more recesses and the one or more nozzle catches (122), which may aid in preventing bottles from unnecessarily shifting from side to side when being placed and removed.

Figure 6:
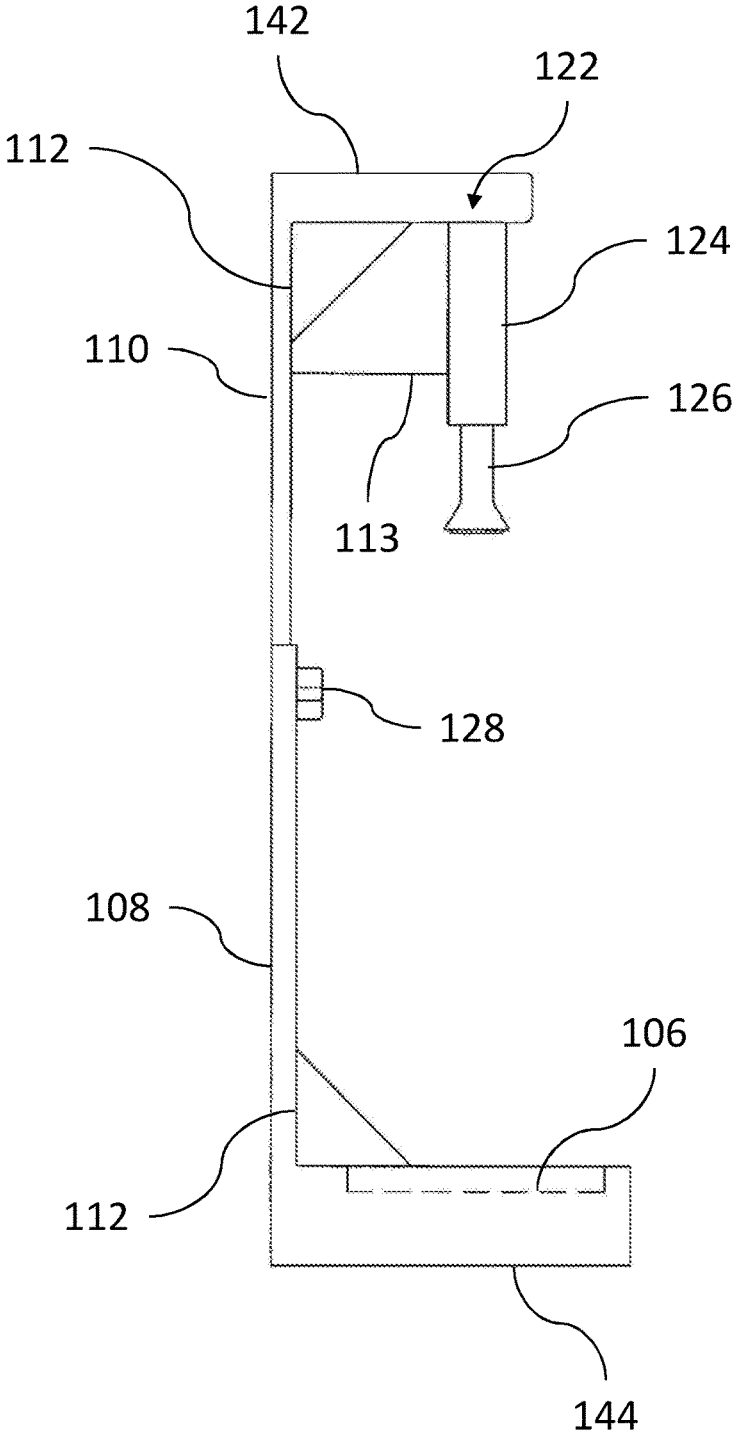
FIG. 6 is a side elevation view of the bottle holder.

FIG. 6 shows a side elevation view of the bottle holder (100). In this view, it can be seen that base (144) and top (142) extend outwards from the bottle holder, as well as the manner in which the angle braces (112) connect the horizontal surfaces (142, 144) to the walls (118, 119) of the bottle holder (100) to provide stability and rigidity. Also shown in FIG. 6 is a nozzle catch brace (113) that extends outwards from the upper wall (119) and attaches to the post (124) of the nozzle catch (122). This brace (113) can be of varying sizes and characteristics, and primarily serves to provide stability and durability to the nozzle catch (122) during operation to prevent post (124) from breaking off at the point where it connects to the top (142).

Figure 7:
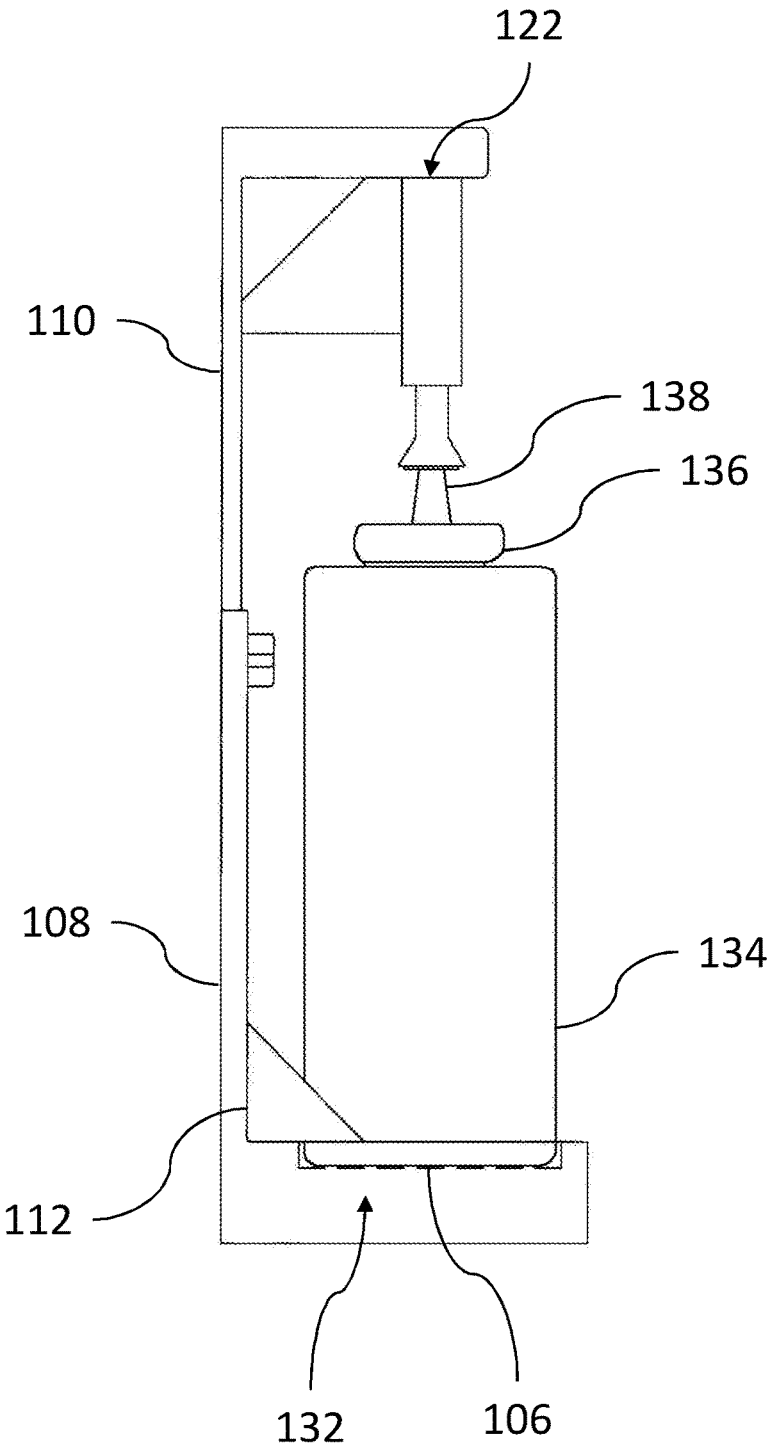
FIG. 7 is a side elevation view of the bottle holder containing a bottle.
Figure 8:
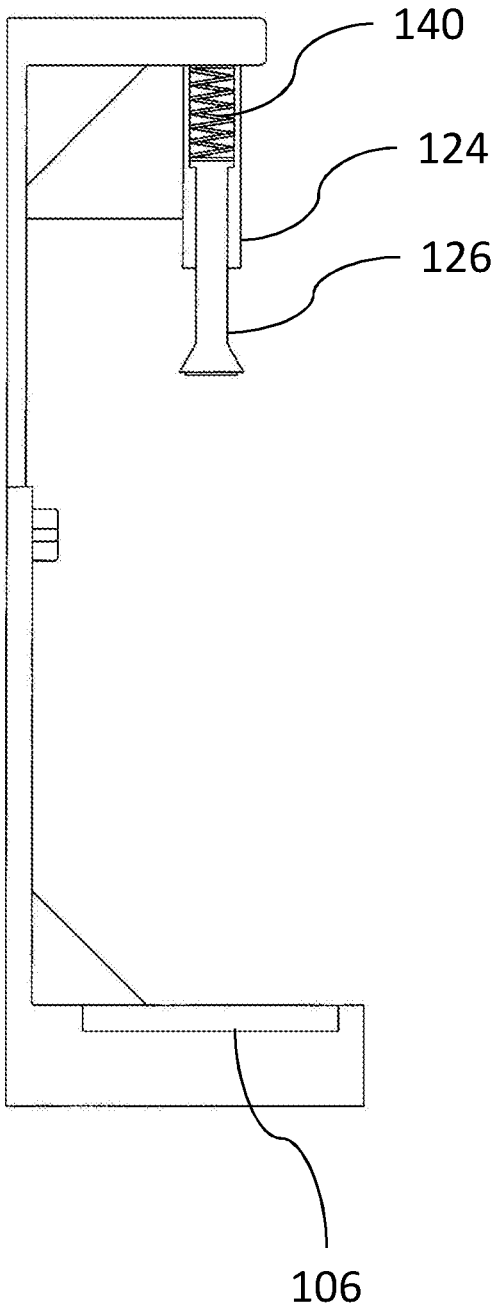
FIG. 8 is a side cross-sectional view of the bottle holder.

FIG. 7 shows a side elevation view of the bottle holder (100) with a bottle (132) held in place between the recess (106) and the nozzle catch (122). FIG. 8 shows a side cross-sectional view of the bottle holder (100) showing a spring (140) inside the post (124). In this view it can be seen that as a nozzle (138) of a bottle (132) pushes upwards and into the nozzle cup (126), the spring (140) will compress and allow the nozzle cup (126) to travel upwards into the post (124). While the bottle (132) is stored, as shown in FIG. 7, the spring (140) will apply a downwards force against the nozzle cup (126) causing it to maintain a seal on the nozzle (138). When the bottle (132) is removed, the spring (140) will push the nozzle cup (126) downwards and return it to its neutral position shown in FIG. 8.

The disclosed features and components provider a user with self-sealing storage of bottles having a variety of sizes and nozzle characteristics, and also allow for simple operation and one-handed operation. For example, as previously discussed, the tapered cup walls (142) of the nozzle cup (126) allow for bottles (132) having various nozzle (138) lengths and circumferences to be seated within and seal against the cup wall (142) or cup terminal (146). The biased nozzle catch (122) allows for bottles (132) having different overall heights to be stored by placing the nozzle (138) into the nozzle cup (126), pressing upwards so that the nozzle cup passes into the post (134) until the bottle (132) bottom edge passes above the base (144), and then moving the bottle (132) forward and back downwards until the bottom of the bottle (132) rests in recess (106), all while the nozzle catch (122) remains pressed against the nozzle (138) by the spring (140). Removal of the bottle (132) is performed by lifting the bottle (132) from the recess (106) and then pulling it outwards over the base (144) and downwards away from the nozzle catch (122) which, as previously described, will return to a neutral position. When secured to a wall or when properly weighted, the bottle holder (100) may be operated with one hand manipulating the bottle (132) as it is placed and removed, since the only other moving component is the nozzle catch (122), which moves upwards as a result of forces applied through the bottle (132) and moves downwards as a result of forces applied by the spring (140) decompressing. This may be useful when, for example, a cook is occupying one hand with a spatula or pan handle, and only one hand is available to reach and take hold of a bottle (132) filled with cooking oil, or when a woodworker is holding two pieces of wood in contact with each other and only one hand is available to reach and take hold of a bottle (132) filled with glue to apply along a seam of the wood. In these situations, the disclosed invention may be immovably mounted or placed nearby and allow for bottles (132) to be placed and removed with only one hand.

Figure 11:
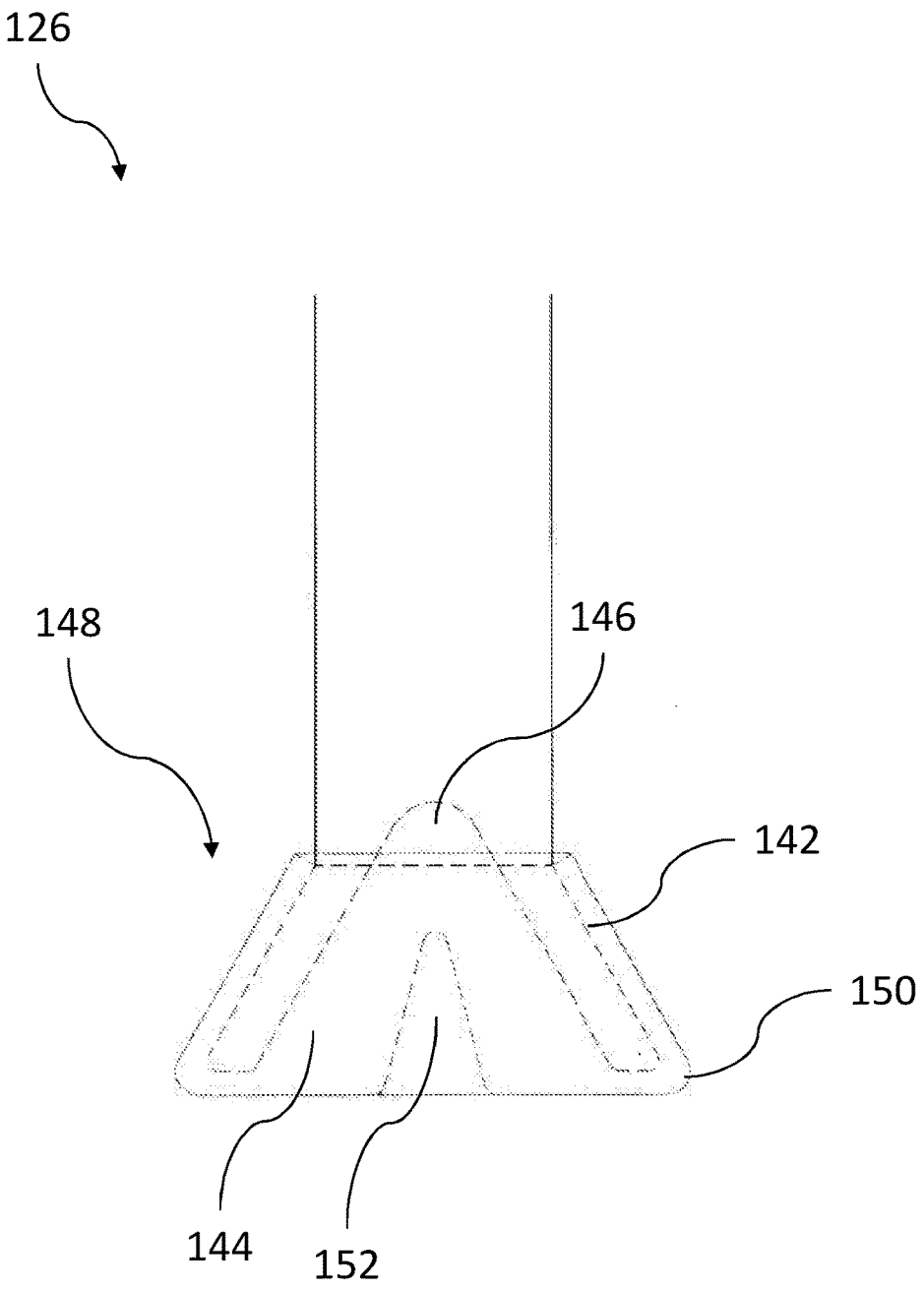
FIG. 11 is a side view of the nozzle cup with a removable cover attached.

FIG. 11 shows a side view of the nozzle cup (126) with a removable cap attached. The cap (148) comprises a cap body (150) and a cap recess (152). When installed, the cap body (150) will fit around the cup wall (142) and hold the cap (148) in place, while the cap recess (152) will fit within the cup walls (142) and occupy a portion of the cup (144). The cap (148) may be made of a variety of materials and may be chosen by a user for a particular application or material type. Use of the cap may provide protection to the non-replaceable components of the nozzle catch (122). For example, if a solvent is stored in a bottle (132), the solvent may over time damage a plastic material used to construct the cup walls (142). A cap (148) may be constructed to resist damage from the solvent, or may simply be replaced when it begins to break down. Likewise, storage of glue in a bottle (132) may over time result in a cup (144) being filled with hardened glue and being rendered inoperable. A cap (148) may be constructed from non-adherable materials, or again may simply be removed and disposed of when it becomes fouled with adhesives such that a seal against the nozzle's opening becomes difficult.

Figure 4:
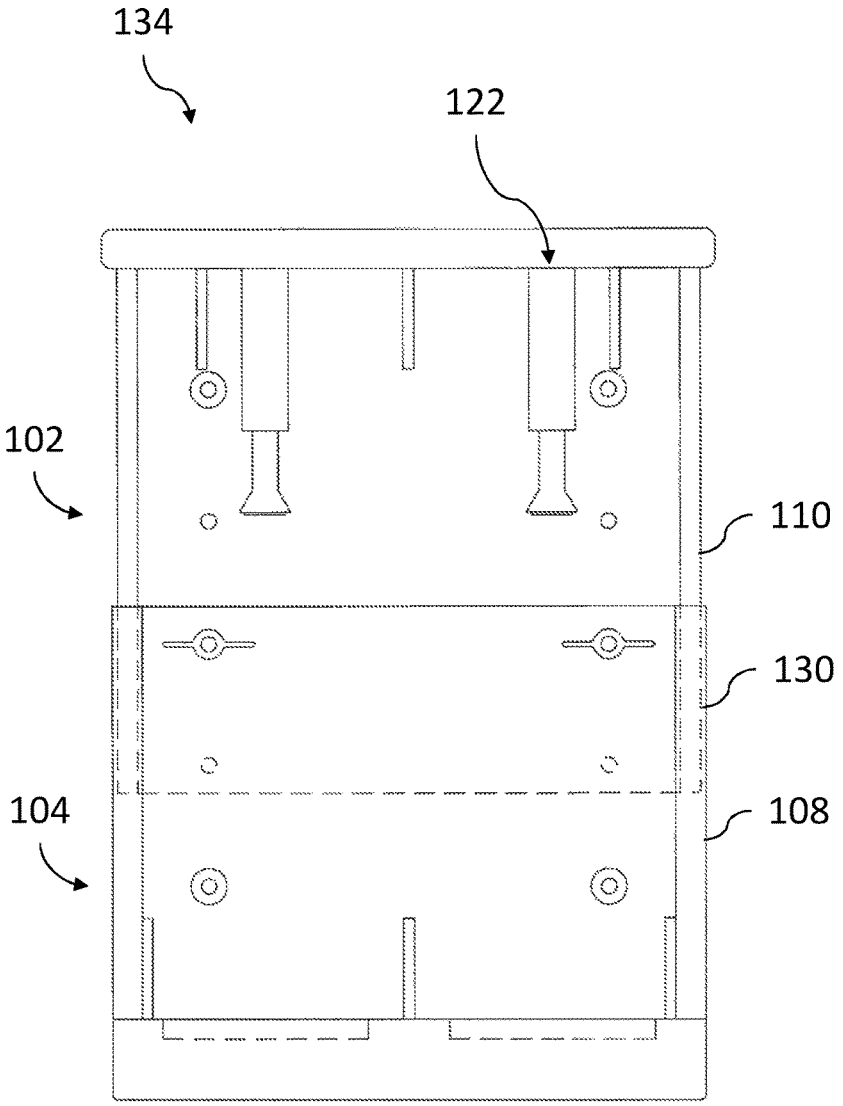
FIG. 4 is a front elevation view of an alternate bottle holder.
Figure 5:
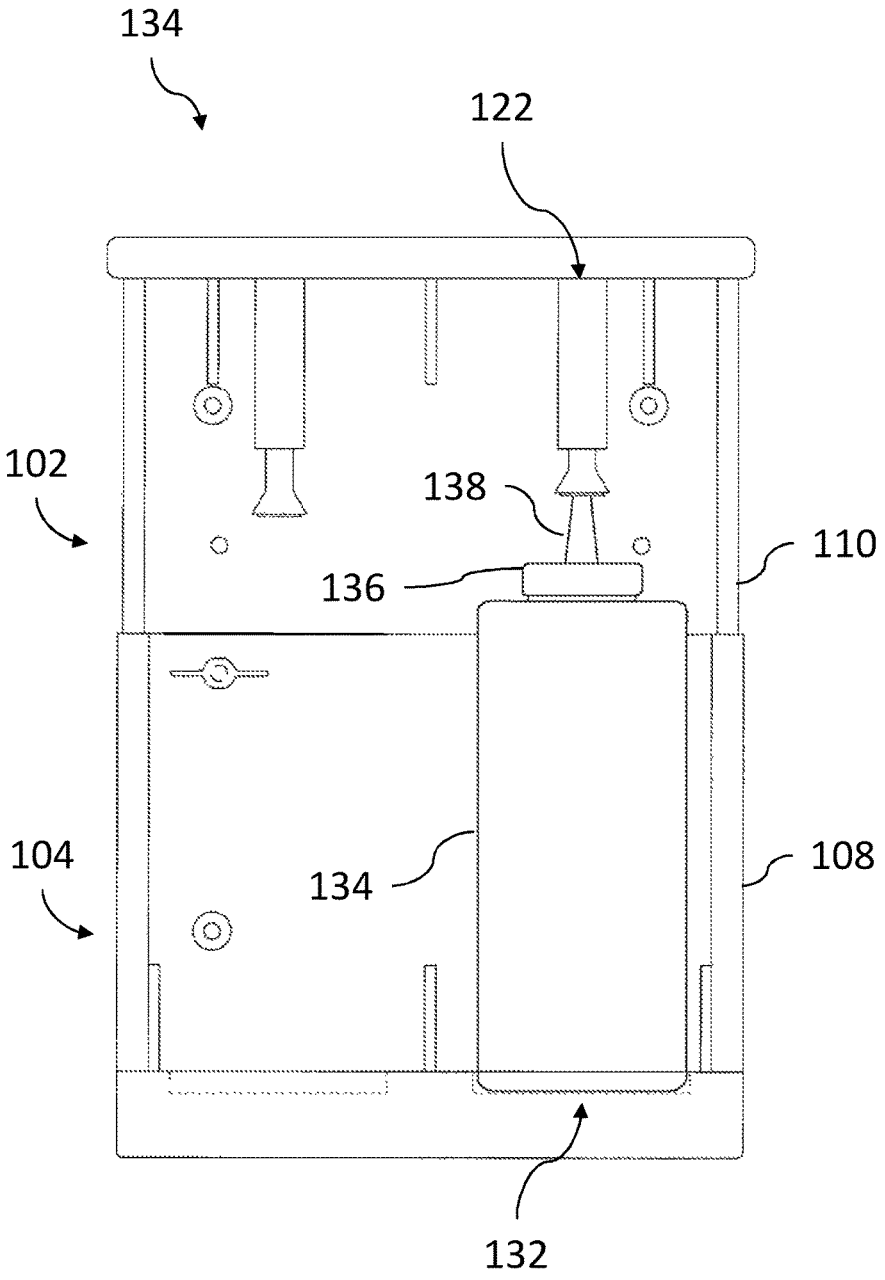
FIG. 5 is a front elevation view of the alternate bottle holder containing a bottle.

While the embodiments that have been shown and discussed have allowed for placement of four bottles (132) in a linear fashion, it should be understood that the disclosed features and components may be implemented in a variety of ways. For example, FIGS. 4 and 5 show a bottle holder (134) having slots for two bottles (132), but having substantially similar components and features as a bottle holder (100) having slots for four bottles (132). Other configurations include, for example, a circular bottle holder having slots for bottles (132) disposed about the outside edge of the circle and being rotatably mounted so that it may spin about its central axis. This could allow for an increased number of bottles (132) that may be accessed by spinning the holder about its central axis until the desired bottle (132) is in view, so that it can then be removed and used. The components of the bottle holder may be composed of any appropriate material, and may include plastics, metals, and other materials that will provide for durability through repeated placement and removal of bottles (132).

Some embodiments of the apparatus disclosed herein may have additional features, or may lack features that have been previously described and discussed. For example, in some embodiments, the recess (106) may not be present in the base (144) of the bottle holder (100), and the bottle may instead rest on the base (144), or on a friction pad or other high-traction surface of the base (144). In some embodiments, instead of or in addition to a recess, a base (144) may have an angled, spring biased latch, such that when a bottle is pressed against the latch it depresses into the base (144), and when the bottle has passed the latch completely it springs back to a neutral position holding the bottle in place against a non-angled side. In some embodiments, the bottle holder (100) may be of unitary construction, rather than being assembled from the upper frame (102) and the lower frame (104).

In some embodiments, there may be multiple sets of fastener holes (116) on the lower frame (104), allowing for additional assembled configurations, or there may be vertically running slots instead of fastener holes (120) to allow for attachment at any point along the slot instead of only at a point where fastener holes (116, 120) align. In some embodiments, there may be no mounting point (114), and instead the base (144), top (142), or both may be heavily weighted so that the bottle holder (100) may be placed on a horizontal surface rather than being mounted on a vertical surface. Alternately, the bottle holder (100) may be attached to a surface by way of an adhesive or other semi-permanent mounting type. In some embodiments, the bottle holder may be installed and used with the nozzle catch (122) extending horizontally and holding the bottle horizontally between the nozzle catch (122) and the recess (106), or may be installed upside down, so that the nozzle catch (122) extends upwards and the bottle is placed into the nozzle catch (122) with its nozzle pointing downwards. Further alternative orientations can be used as will occur to those skilled in the art in view of this disclosure.

It should be understood that any one or more of the teachings, expressions, embodiments, examples, etc. described herein may be combined with any one or more of the other teachings, expressions, embodiments, examples, etc. that are described herein. The teachings, expressions, embodiments, examples, etc. should therefore not be viewed in isolation relative to each other. Various suitable ways in which the teachings herein may be combined will be readily apparent to those of ordinary skill in the art in view of the teachings herein. Such modifications and variations are intended to be included within the scope of the claims.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

What is claimed is:

1. A bottle holder comprising:

(a) a frame comprising a wall, a first extension portion, and a second extension portion, wherein the first extension portion and the second extension portion each extend outward from the wall; and (b) at least one nozzle catch that extends from the first extension portion, the nozzle catch comprising a nozzle cup and a post, wherein the nozzle cup is movably attached to the post and is movable in at least two directions relative to the post, the nozzle cup comprising a tapered inner cup;

wherein the tapered inner cup is configured to contact a nozzle of a bottle when the nozzle is placed in the tapered inner cup and a base of the bottle is placed on the second extension portion such that the bottle is held between the nozzle catch and the second extension portion.

2. The bottle holder of claim 1, wherein the nozzle and the tapered inner cup are each conically shaped, and wherein an opening of the nozzle contacts inside of the tapered inner cup when the nozzle is inserted into the tapered inner cup.

3. The bottle holder of claim 1, wherein the frame comprises a first frame piece and a second frame piece, wherein the first frame piece comprises a first set of fastener holes and the second frame piece comprises a second set of fastener holes, and wherein the first set of fastener holes and the second set of fastener holes are positioned such that one or more of the first set of fastener holes may be aligned with one or more of the second set of fastener holes so that one or more fasteners may be passed through respective ones of the first set of fastener holes and the second set of fastener holes to attach the first frame piece to the second frame piece.

4. The bottle holder of claim 3, wherein the first frame piece comprises a first rail edge and the second frame pieces comprises a second rail edge, and wherein the first rail edge and the second rail edge are coupled when the first frame piece is attached to the second frame piece such that side-to-side movement of the first frame piece relative to the second frame piece is reduced.

5. The bottle holder of claim 3, wherein the first set of fastener holes and the second set of fastener holes are positioned such that the one or more fasteners may be placed in different sets of fastener holes in order to increase or reduce the size of an overlap region where the first frame piece and the second frame piece overlap each other.

6. The bottle holder of claim 1, wherein the nozzle catch further comprises a spring that is positioned relative to the post to:

(a) compress as the nozzle cup moves towards the spring due to a force applied to the nozzle cup toward the spring;

(b) decompress and move the nozzle cap away from the spring when the force is removed.

7. The bottle holder of claim 1, wherein the nozzle cup is movable in two directions such that the bottle holder can hold bottles of a maximum bottle height and a minimum bottle height, wherein the difference between the maximum bottle height and the minimum bottle height is about 4 inches.

8. The bottle holder of claim 1, wherein the tapered inner cup can contact the nozzle having a diameter of between about one tenth of an inch and about one half of an inch.

9. The bottle holder of claim 1, wherein the bottle holder is configured to hold at least two bottles simultaneously, and wherein a set of divider braces extend from the wall to the first extension portion and the second extension portion, and wherein a pair of divider braces of the set of divider braces surround at least a portion of each of the at least two bottles when they are held.

10. The bottle holder of claim 1, further comprising at least one recess in the second extension portion that faces the first extension portion, wherein the at least one nozzle catch is substantially centered relative to the recess, wherein the recess is circular and of a depth that prevents the bottle from being removed from the bottle holder without first moving it away from and out of the recess.

11. The bottle holder of claim 1, further comprising a removable cap, wherein the removable cap is configured to be placed within the tapered inner cup so that it prevents the nozzle or a material within the bottle from directly contacting the tapered inner cup.

12. The bottle holder of claim 11, wherein the removable cap is tapered such that the nozzle contacts the removable cap when the nozzle is inserted into the removable cap.

13. The bottle holder of claim 11, wherein the removable cap comprises a flexible inner wall, wherein the flexible inner wall conforms to the shape of an opening of the nozzle as the nozzle is inserted into the removable cap.

14. A method for storing a bottle in a bottle holder, comprising the steps of:

(a) placing a nozzle of the bottle in a nozzle cup of a nozzle catch of the bottle holder;

(b) moving the nozzle toward the nozzle cup, causing the nozzle cup to move in a first direction relative to a post of the nozzle catch, compressing a spring, until a base of the bottle is clear of a first horizontal portion of the bottle holder;

(c) moving the base toward a wall of the bottle holder so that it passes the first horizontal portion; and (d) moving the base away from the nozzle catch so that it rests in a recess of the first horizontal portion, allowing the spring to decompress and place the nozzle cup in contact against an opening of the nozzle while the base is within the recess.

15. The method of claim 14, further comprising the step of, before the placing step, placing a removable cap over the nozzle cup, wherein the removable cap prevents the nozzle and any material within the bottle from contacting the nozzle cup.

16. The method of claim 15, further comprising the step of selecting the removable cap based upon a cap material of the removable cap and a material characteristic of a material that is stored in the bottle.

17. A bottle holder comprising:

(a) a frame comprising a wall, a first horizontal portion, and a second horizontal portion, wherein the first horizontal portion and the second horizontal portion each extend outward from the wall;

(b) at least one nozzle catch that extends from the first horizontal portion, the nozzle catch comprising a nozzle cup and a post, wherein the nozzle cup is movably attached to the post and is movable in at least two directions relative to the post, the nozzle cup comprising a tapered inner cup; and (c) a removable cap configured to be placed within the tapered inner cup so that it prevents a nozzle of a bottle and any material within the bottle from contacting the tapered inner cup directly when the bottle is held by the bottle holder;

wherein the removable cap is tapered such that the nozzle contacts a contact point on the removable cap when the nozzle is inserted into the removable cap, wherein the bottle is held between the nozzle catch and a recess in the second horizontal portion when the nozzle is inserted into the removable cap and a base of the bottle is inserted into the recess, and wherein the recess is circular and of a depth that prevents the bottle from being removed from the bottle holder without first moving it away from and out of the recess.

* * * * *